US005197853A

United States Patent [19]

Creevy et al.

[11] Patent Number: 5,197,853

[45] Date of Patent: Mar. 30, 1993

[54] AIRTIGHT SHROUD SUPPORT RAIL AND METHOD FOR ASSEMBLING IN TURBINE ENGINE

[75] Inventors: Clifford S. Creevy, Mainesville; Terry T. Eckert, Fairfield, both of Ohio

[73] Assignee: General Electric Company, Cincinnati, Ohio

[21] Appl. No.: 750,993

[22] Filed: Aug. 28, 1991

[51] Int. Cl.[5] ..... F01D 9/04

[52] U.S. Cl. ..... 415/115; 415/173.1; 29/889.22

[58] Field of Search ..... 415/115, 116, 170.1, 415/173.1, 173.5, 173.7, 174.5; 29/888.01, 888.02, 888.022, 888.023, 888.024, 888.025, 888.3, 889.2, 889.21, 889.22

[56] References Cited

U.S. PATENT DOCUMENTS 3,412,977 11/1968 Moyer et al. .
4,087,199 5/1978 Nemsworth et al. ..... 415/173.3
4,238,170 12/1980 Robideau et al. .
4,355,952 10/1982 Brown et al. ..... 415/115
4,529,355 7/1985 Wilkinson .

*Primary Examiner*—Edward K. Look
*Assistant Examiner*—Christopher Verdier
*Attorney, Agent, or Firm*—Jerome C. Squillaro; John R. Rafter

[57] ABSTRACT

A shroud support for use in a gas turbine engine having a foot section which is equipped with two continuous rails which extend in a circumferential manner forming a gap between them. The rails contact a foot section of a shroud and prevent cooling air from leaking from a plenum formed by the shroud support to a position to the aft of the foot sections of the shroud and shroud support.

3 Claims, 3 Drawing Sheets

AIRTIGHT SHROUD SUPPORT RAIL AND METHOD FOR ASSEMBLING IN TURBINE ENGINE

CROSS-REFERENCE

Reference is made to a co-pending and related case filed concurrently herewith having U.S. patent application Ser. No. 07/750,991, which is herein incorporated by reference.

BACKGROUND OF THE INVENTION

1. Field of the Invention

The present invention relates to shroud supports for use in gas turbine engines and more particularly relates to a shroud support having an aft end region which is equipped with two rails which function as an air-tight seal. The two rails define a gap which is located above an aft region of a shroud. The two rails prevent cooling air from escaping to the aft of the shroud support thereby reducing the amount of cooling air needed to cool the shroud. Since the present invention reduces the need for cooling air, more air can be utilized to enhance engine performance.

2. Discussion of the Background

FIG. 1 is an exemplary schematic illustration of the first stage of a two-stage high pressure turbine located in a gas turbine engine. Very hot gas, identified as gas flow 4, exits the combustor 6 and flows through vane 8 and rotor or turbine blade 10 in the initial turbine stage. The rotor blades of the turbine, such as rotor blade 10, convert energy contained in the gas flow 4 into mechanical energy which drives the upstream high pressure compressor (not shown).

With further reference to FIG. 1, located radially outward from the combustor 6 is cooling air flow 12 which originates from the high pressure compressor. Holes in the support arm 14 allow the cooling air 12 to continue to flow in at aft direction toward the shroud 16 and shroud support 18. The shroud support is connected to an outer casing 20 by means of hooked connections. The shroud support 18, as its name implies, is connected to and supports the shroud 16. Shroud support 18 forms a plenum from which cooling air 12 is directed onto shroud 16. A plurality of shrouds and shroud supports extend circumferentially around the turbine stage of the gas turbine engine with two shrouds being supported by each shroud support. Rotor blades are located radially inward of the shrouds.

The shrouds are secured above the rotor blades so as to provide tight radial clearance for efficient engine operation. Thus, shroud 16 is located very close to the working medium gas flow (i.e., hot gas flow 4). In fact, the radially inward side of the shroud is exposed to temperatures which can actually exceed the melting point of the metal from which the shroud is made. However, the shroud does not melt as a result of the cooling air flow 12 which is directed along its radially outward side.

Thus, it is important that the shroud support remain relatively cool as compared to the shroud to which it is connected. Furthermore, to reduce heat conduction from the shroud, the amount of surface area contact between the shroud and shroud support has typically been minimized. Existing designs have reduced conduction by spacing pads circumferentially around the shroud support surface. Such a design effectively reduces the contact area between the shroud support and the shroud, but it does not prevent leakage flow of cooling air from escaping between pads to the aft of the shroud support. Such leakage results in significant amounts of cooling air being wasted.

Thus, a need exists for a shroud support which is provided with a means for reducing heat conduction and which significantly reduces or eliminates the leakage of cooling air.

SUMMARY OF THE INVENTION

Accordingly one object of the present invention is to provide a shroud support which significantly reduces the leakage of cooling air.

Yet another object of the present invention is to provide a shroud support which reduces heated conduction from the attached shroud.

Still another object of the present invention is to provide a shroud support which aids in the efficient operation of a gas turbine engine.

These and other valuable objects and advantages of the present invention are provided by a shroud support for a gas turbine engine which supports a shroud which is located radially outward from a blade. The shroud support has a foot section for interfacing with a foot section of the shroud with both foot sections being exposed to a cooling air flow. The foot section of the shroud support has two continuous rails which extend in a circumferential manner about the portion of the engine covered by the shroud support. Between the two continuous rails is a gap. The two continuous rails make contact with the foot section of the shroud and prevent the cooling air flow from leaking to a position to the aft of the foot section of the shroud support.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it is understood that like reference numerals designate identical or corresponding parts throughout the respective figures.

DETAILED DESCRIPTION OF THE INVENTION

Figure 1:
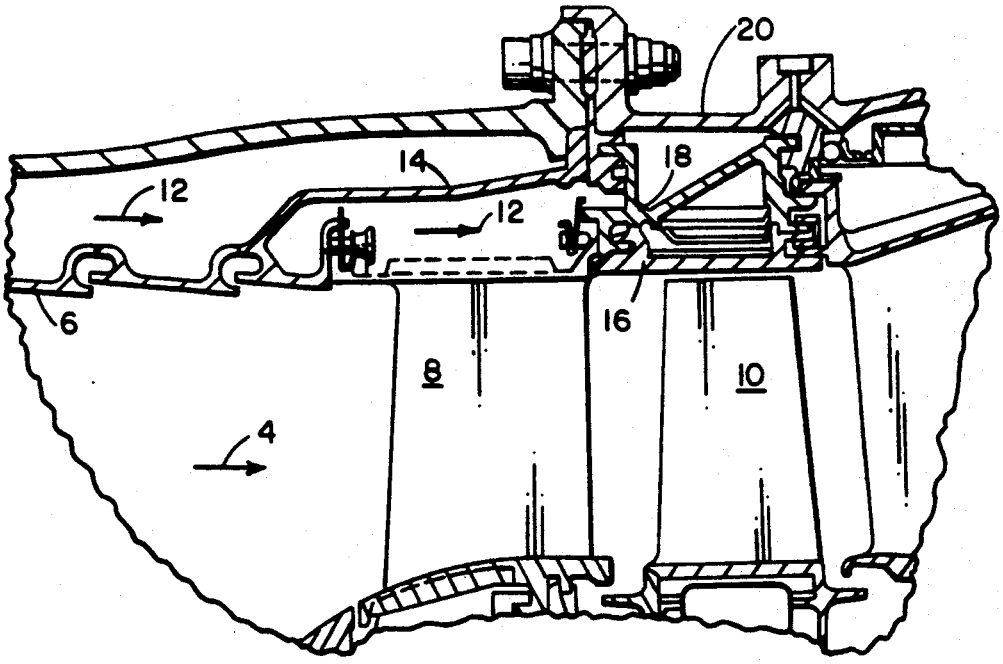
FIG. 1 (PRIOR ART)
FIG. 1 is a schematic illustration of an exemplary turbine section of a gas turbine engine.
Figure 2A:
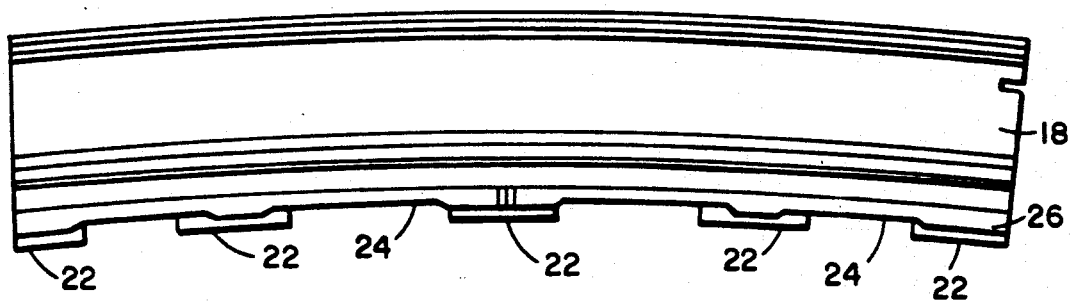
FIG. 2A (PRIOR ART)
FIG. 2A is a prior art schematic, axial end view illustration of a shroud support and insulation pads.
Figure 2B:
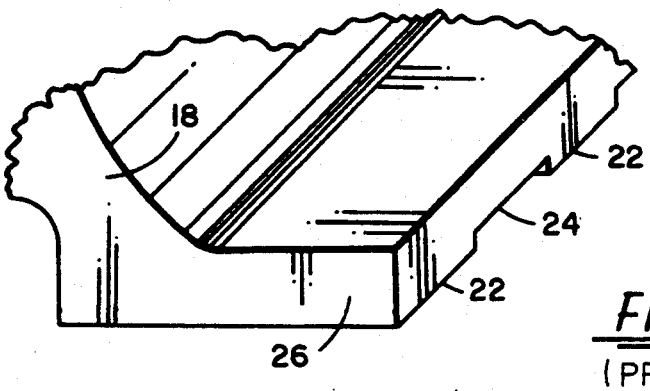
FIG. 2B (PRIOR ART)
FIG. 2B is a perspective illustration of a foot section of a prior art shroud support and depicts the circumferentially spaced pads attached to the radially interior side of the foot section.

With reference to FIG. 2A, the axial end view reveals that prior art shroud support 18 has a foot section 26. Positioned on the underside or radially inward side of foot section 26 are a plurality of pads 22 which are spaced in a circumferential fashion. In FIG. 2B, a perspective illustration gives the reader a clearer understanding of foot section 26 of shroud support 18. The pads 22 extend from the front end of foot section 26 to the aft end of foot section 26. These pads 22 provide contact between the shroud support 18 and an adjacent shroud 16 at spaced intervals so as to reduce the contact area and reduce heat conduction from shroud to shroud support. As a result of the spacing of pads 22, gaps 24 are formed therebetween. The gaps 24 likewise extend from the front of foot section 26 to the aft of foot section 26. These gaps provide a leakage path by Which cooling air 12 (see FIG. 1) is allowed to escape to the rear of foot section 26 thereby diminishing the cooling effect on shroud 16.

Until recently, the leakage paths provided by gaps 24 were considered to be an insignificant problem. However, the significance of the problem posed by the leakage paths has been reconsidered in light of increased performance demands and higher shroud cooling requirements due to elevated gas path temperatures. Although the spaced pads 22 provide an effective reduction of heat conduction between the shroud 16 and shroud support 18, the gaps 24 created by the pads 22 allow some cooling air to escape.

Figure 3:
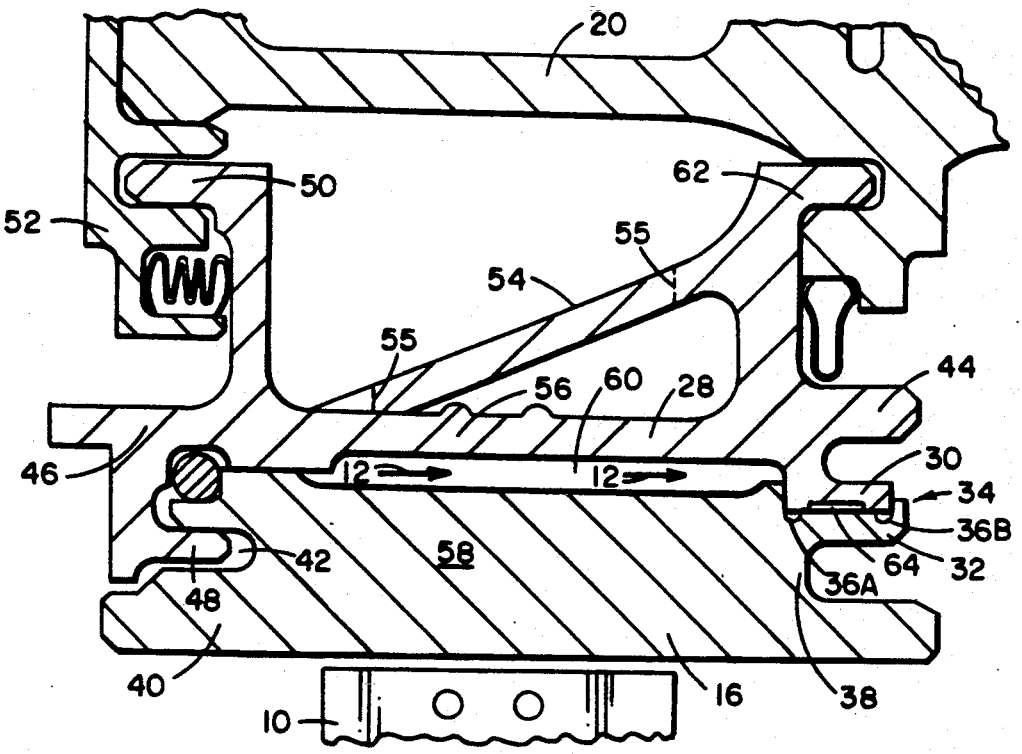
FIG. 3 is a simplified schematic, side view illustration of a shroud support and connected shroud according to the present invention.

FIG. 3 is a side view schematic illustration of the shroud support 28 of the present invention connected to shroud 16. Shroud support 28 is similar to shroud support 18 of FIGS. 2A and 2B; however, the foot section 30 of shroud support 28 is distinctly different.

The shroud support 28 has a forward end region 46, a mid-section region 56, and an aft end region 44. Shroud 16 has a forward end region 40, a mid-section region 58, and an aft end region 38. The lower extreme region of aft end 44 of shroud support 28 is comprised of foot section 30 which connects to the upper extreme of aft end 38 of shroud 16. This upper extreme of the aft end of shroud 16 is designated as the foot section 32 of shroud 16. Together, foot sections 30 and 32 comprise foot region 34. Foot section 32 has stress relieving grooves 36A and 36B which interface with the extreme forward underside and the extreme rear underside of foot section 30 of support shroud 28.

A lower forward hook 48 of shroud support 28 fits in a forward groove 42 of shroud 16. An upper forward hook 50 of shroud support 28 fits in a groove in flange 52 which is connected to outer casing 20. An aft hook 62 of shroud support 28 secures the upper aft region of shroud support 28 to a groove in outer casing 20. The foot region 34 is secured together by a C-clip 70 (shown in FIG. 5).

Figure 4:
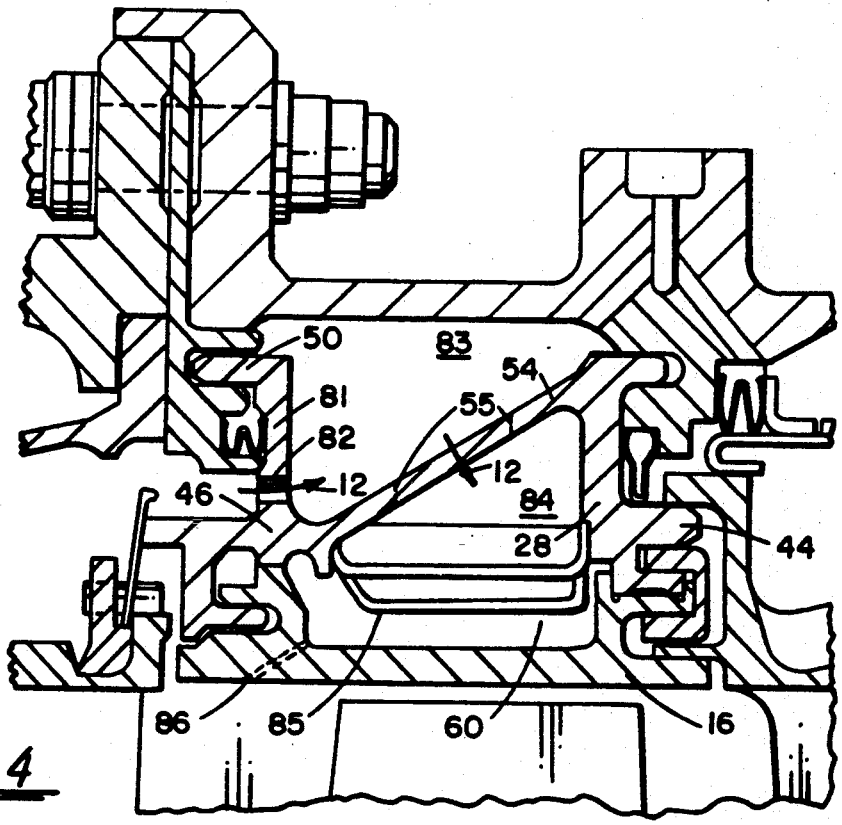
FIG. 4 is a closeup side view illustration of the shroud support and connected shroud according to the present invention and depicts holes through which cooling air is channeled.

With reference to FIG. 4, there is shown another view of support 28 illustrating the adjacent elements to the support. A diagonal support 54 of shroud support 28 connects to the front of mid-section region 56 (FIG. 3) and to the top of aft end 44. A forward vertical member 81 contains holes 82 which allow cooling air 12 to enter chamber 83. The diagonal support 54 is equipped with holes indicated by dashes 55 which provide a passage for circulating air to pass from chamber 83 to chamber 84. Shroud support 28 contains a plate 85 which has multiple holes (not shown) that impinge cooling air on the outer radial side of shroud 16 for the purpose of reducing the shroud metal temperature to acceptable levels. The plate 85 is brazed to the mid-section region 56 (FIG. 3) of shroud support 28. The holes in the plate 85 allow cooling air from chamber 84 to reach plenum 60. The impinging air collects in plenum 60 before exiting as either leakage or as cooling air which passes through film holes 86 in shroud 16.

In the past, the insulation pads 22 of FIGS. 2A and 2B, by forming flow gaps 24, resulted in the cooling air flow 12 being allowed to escape by flowing through the foot section of the support shroud.

However, foot section 30 of support shroud 28, according to the present invention, is provided with a means for preventing escape of cooling air flow.

Figure 5:
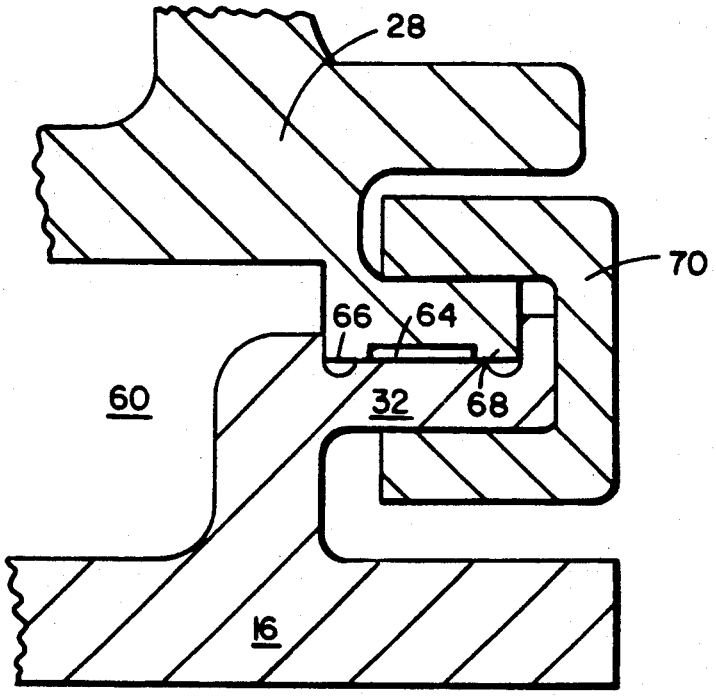
FIG. 5 is a simplified, closeup schematic illustration of foot section of the shroud support and foot section of a corresponding shroud secured by a C-clip according to the present invention.

FIG. 5 is an enlarged sectional view of foot section 30 illustrating how foot sections 30 and 32 are secured together by C-clip 70. The underside of foot section 30 is provided with a continuous forward rail 66 and a continuous aft rail 68 which form a gap 64. Rails 66 and 68 contact foot section 32 of shroud 16. Rails 66 and 68 extend circumferentially and prevent cooling air from leaking through the foot region 34 and exiting to the rear of the foot region. Thus, the cooling air flow 12 remains in plenum 60 (FIG. 3) where it is better utilized for the cooling of shroud 16.

Figure 6:
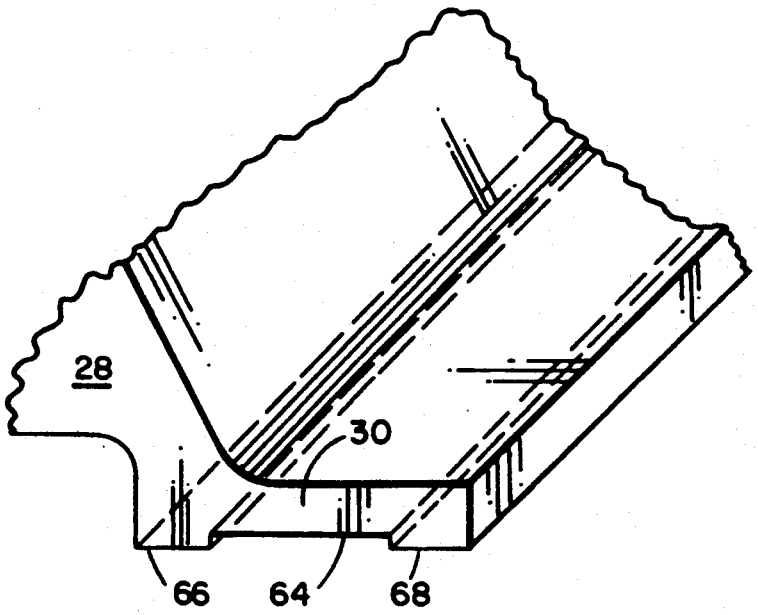
FIG. 6 is a perspective illustration of a shroud support according to the present invention having two continuous circumferential rails which define a gap therebetween.

With reference to FIG. 6, the continuous nature of rails 66 and 68 is better appreciated. The rails prevent the flow of air in a forward to aft direction.

In that a plurality of shroud supports and shrouds such as shroud support 28 and shroud 16 are circumferentially connected around the turbine section of a gas turbine engine, an annular space is formed as a result of the summation of plenums 60 (FIG. 5). Likewise an annular gap is formed as a result of the summation of gaps 64 (FIG. 5). Each shroud support is associated with corresponding shrouds, the corresponding shrouds being located radially outward of the turbine blades.

The gap 64 formed by the rails 66 and 68 reduces the surface area of foot section 30 which contacts foot section 32 of the shroud. Thus, the amount of heat conducted is reduced similarly to that of the prior art. However, in that leakage of cooling air is significantly reduced by the present invention, more air is available for conversion to mechanical energy and the efficiency of the engine is improved.

The foregoing detailed description of the invention is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A shroud support for use in a gas turbine engine including rotor blades, the shroud support supporting a shroud located radially outward from the rotor blades, said shroud support forming a plenum area with the shroud, said shroud support having a foot section for interfacing with a foot section of the shroud with both foot sections being exposed to a cooling air flow, said foot section of said shroud support comprising:

two continuous rails extending in a circumferential manner about the portion of the engine covered by said shroud support, said two continuous rails defining a gap therebetween, and each of said two continuous rails making planar contact with a radially outer surface of the foot section of the shroud, said two continuous rails forming an airtight seal with said shroud for preventing cooling air from leaking from the plenum area to a position to the aft of said foot section of said shroud support, through the interface between said shroud and said shroud support at said foot section.

2. A plurality of shroud supports connected circumferentially in an engine, said plurality of shroud supports supporting a plurality of shrouds which are located radially outward from a plurality of rotor blades, each shroud support of said plurality of shroud supports forming a plenum area with an individual shroud of said plurality of shrouds, each said shroud support having a foot section for interfacing with a foot section of the individual shroud of said plurality of shrouds, said foot seciton of each shroud support and the foot section of the individual shroud being exposed to a cooling air flow, each shroud support of said plurality of shroud supports comprising:

two continuous, circumferential rails defining an annular gap therebetween for circumscribing the engine, wherein said two continuous, circumferential rails reduce heat conduction between each said shroud support and shroud and make planar contact with said shroud for forming an airtight seal between said shroud and said shroud support to preventing the cooling air from leaking from the plenum area formed by each said shroud support to a position to the aft of said plurality of shroud supports through the interface at said foot section of said shroud and said shroud support.

3. A method of assemblying a gas turbine engine, the gas turbine engine including a plurality of circumferentially connected shroud supports with each shroud support of the plurality of shroud supports to be used to support at least one shroud of a plurality of circumferentially connected shrouds, each shroud support of said plurality of shroud supports having a foot section having two rails which extend in a circumferential manner defining a gap therebetween, said method comprising the step of:

associating and making planar contact between said foot section of each said shroud support and a foot section of the at least one shroud such that an annular gap is formed between the two rails and an airtight seal is formed between the shroud and shroud support.

* * * * *